United States Patent [19]

Steier et al.

[11] Patent Number: 4,830,597

[45] Date of Patent: May 16, 1989

[54] VIBRATOR FOR A BLOCK MOLDING MACHINE

[75] Inventors: Klaus F. Steier, Munich; Erich W. Holthaus, Remscheid; Hermann Kargl, Munich, all of Fed. Rep. of Germany

[73] Assignee: Knauer GmbH Maschinenfabrik, Fed. Rep. of Germany

[21] Appl. No.: 86,964

[22] Filed: Aug. 19, 1987

[30] Foreign Application Priority Data

Aug. 27, 1986 [DE] Fed. Rep. of Germany ..... 3629078
Mar. 20, 1987 [DE] Fed. Rep. of Germany ..... 3709112

[51] Int. Cl.[4] ..... B06B 1/16; B28B 1/08

[52] U.S. Cl. ..... 425/456; 164/203; 173/49; 209/367

[58] Field of Search ..... 425/421, 456, 424; 164/203; 264/69, 71, 72; 173/49; 209/367

[56] References Cited

U.S. PATENT DOCUMENTS

| | | | |
|---|---|---|---|
| 1,118,103 | 11/1914 | Beierlein . | |
| 1,154,408 | 9/1915 | Steuermann . | |
| 2,695,523 | 11/1954 | Oswalt | 425/456 |
| 2,703,405 | 3/1955 | Pappers . | |
| 2,736,264 | 3/1956 | Fechter . | |
| 3,743,468 | 7/1973 | Helmrich et al. | 425/421 |
| 4,140,744 | 2/1979 | Karas et al. | 425/421 |
| 4,179,258 | 12/1979 | Karas et al. | 425/421 |
| 4,238,177 | 12/1980 | Crile | 425/150 |

FOREIGN PATENT DOCUMENTS 0070344 2/1985 European Pat. Off. .

OTHER PUBLICATIONS

Advertisement of Schlosser in "Betonwerk und Fertigteil-Technik," No. 3, 1986, cover page and p. 194.

Sonnenberg, R., "Vibratory Compaction in Block Machines," Betonwerk und Fertigteil-Technik, No. 8, 1979, pp. 478–485.

*Primary Examiner*—Willard Hoag

*Attorney, Agent, or Firm*—Webb, Burden, Ziesenheim & Webb

[57] ABSTRACT

A vibrator for a concrete block molding machine to make molded concrete blocks comprises a vibrating table which receives wooden production pallets with a block mold on support bars and further comprises a vibrating drive. Infinitely adjustable amplitude level and frequency setting of the vibrating table is permitted because the vibrating drive means comprises four unbalanced vibrating shafts disposed especially in pairs beside and above each other. Those of the vibrating shafts which are arranged horizontally beside each other are adapted to be driven in contrary sense at the same number of revolutions by way of universal joint shafts from a regulator and distributor transmission. An hydraulic drive motor attached to the transmission is fed from an hydraulic pump of adjustable delivery volume of the hydraulic unit. Thus the vibrating frequency is adjustable by the rotational drive speed of the two horizontal vibrating shaft pairs (directional oscillators). The transmission further serves to vary the phase position of the vibrating shaft pairs with respect to each other and thus the oscillation amplitude of the vibrating table. A control means may be provided to sense the acceleration of the vibrating table and production pallet.

16 Claims, 3 Drawing Sheets

VIBRATOR FOR A BLOCK MOLDING MACHINE

The instant invention relates to a vibrator for a concrete block molding machine to make molded concrete blocks on board-like, especially wooden production pallets which are caused to oscillate in vertical direction.

Figure 1A:
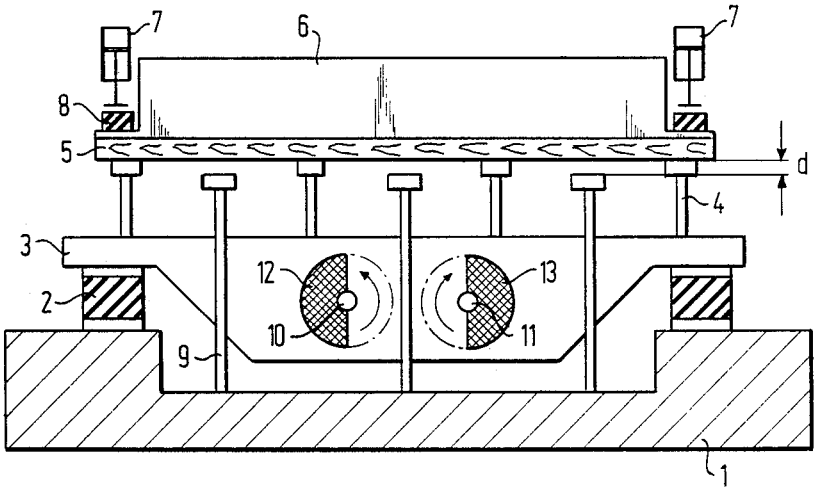
Figure 1B:
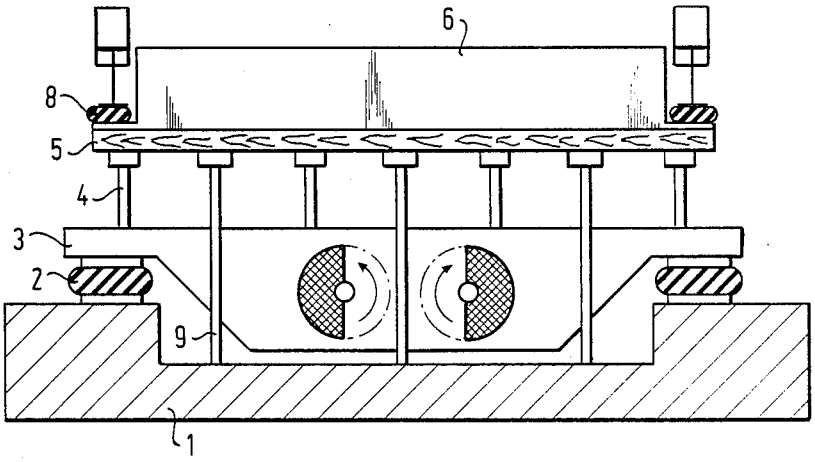

Concrete block molding machines of that nature have been used for a long time to produce molded concrete blocks (Crile et al. U.S. Pat. No. 4,238,177). In the course of time two embodiments have made their way, namely machines with vibrating tables approximately of the same size as the production pallets, in other words with but one vibrating table, and machines with combinations of vibrating tables of up to six individual tables having an overall area which corresponds approximately to the dimensions of the production pallet. A vibrator including one vibrating table of the size of the production pallet is shown in FIGS. 1*a* and 1*b* which indicate the basic structure. As may be seen, a vibrating table 3, supported by spring members 2 with respect to a foundation or machine frame 1, comprises upwardly projection support bars 4 to receive board-like, especially wooden production pallets 5 on which a block mold 6 is lowered. Hydraulic cylinders 7 acting through intermediate spring members 8 force the block mold together with the production pallet 5 down to the level of so-called impact bars 9 which are supported on the machine frame 1, cf. FIG. 1*b*. Two vibrating shafts 10,11 each provided with an unbalance or flyweight are supported parallel to each other in the vibrating table 3. They are adapted to be driven in opposite sense at the same rotational speed and can generate a vertical force component only since both flyweights 12 and 13 are of the same magnitude. They present a directional oscillator (as opposed to a free oscillator, such as used above all to operate vibrator sieves).

When the unbalanced vibrating shafts 10 and 11 rotate, the support bars 4 knock against the bottom side of the production pallet 5 which is pressed against the impact bars 9. The intensity of the resulting knocking load is variable. In known vibrators it is determined largely by the difference in level d, cf. FIG. 1*a*, between the plane of the support bars 4 and the plane of the impact bars 9, the mold contact pressure, and the so-called shortcircuit amplitude (double amplitude of the sinusoidal free vibrating motion of the vibrating table 3), and the vibrating frequency. The decision whether to use the first or second embodiment of the vibrating mechanism preferably is based on whether a large one-piece vibrating table or a combination of vibrating tables is available. Here again there are two embodiments. In the one case, mostly used with one-piece vibrating tables, there are two parallel, unbalanced vibrating shafts which are driven in contrary sense from external threephase current motors through universal joint shafts and preferably positively synchronized by a pair of gears. With the other embodiment, vibrator motors, so-called outside vibrators, i.e. three-phase or rotary current motors having an fly weight rotor shaft are installed paraxially in pairs at the vibrating table. They are connected to the mains in such manner that their directions of rotation are opposed. The table structure which necessarily must resist bending results in synchronous revolution (self-synchronization) of the rotor shafts which otherwise are mechanically independent of each other.

The phenomenon of self-synchronization exclusively appears with two vibrator motors installed with their axes in parallel, and this explains why they are so widely used with vibrators supporting a production pallet on several tables.

The choice of such table combinations is a means of raising the built-in motor output and the unbalance of the total vibration beyond 5.2 kW and 50,000 N of centrifugal force because the biggest vibrator available on the market which is suitable for installation in concrete block molding machinery has a motor performance of 2.6 kW at 25,000 N centrifugal force.

Big single tables also can be operated with outside vibrators or vibrator motors. In that event two parallel rows are formed of two or three vibrators per row arranged axially one behind the other, and the rotor shafts of the vibrators which are lined up one behind the other are connected mechanically by couplings. The rotor shafts of the vibrators of both rows then will revolve in self-synchronism, as explained above.

With both designs of vibrators and thus also with both types of table, the vibrating frequency is fixed by the frequency of the mains supplying th electricity. A change of frequency is possible only by means of very expensive frequency converters. A change of the unbalance of the vibrating shafts during operation is impossible with most structures or can be had at great mechanical expenditure only, the adjustment being made at the revolving vibrating shaft in the oscillating table.

It is advantageous to provide for some vibration (previbration) during the mold filling process so as to assure that the concrete block mold is filled uniformly. Such previbration is absolutely necessary in making paving blocks which a cover layer (i.e. use of two types of concrete). The final strength of the concrete blocks is determined greatly by the final compaction (principal or main vibration). The acceleration (g) during previbration and main vibration preferably is of the same order of magnitude (Prof. Otto Graf "Die Eigenschaften des Betons" (the properties of concrete), Stuttgart, 1960, pp. 138/139). Yet the amplitude (a) should be smaller during pre-vibration while the frequency (f) should be greater according to the term $$g = a \cdot f^2$$

than during the final compacting. As explained above, the known vibrating drive means do not permit such adaptations to be made, or permit them to be accomplished at great expenditure only.

After a certain time of operation, both hard new production pallets and soft old ones are found in the same circulation system. As a consequence, optimum compaction of the concrete is not achieved unless the vibration is adapted to the respective pallet hardness. In other words, the acceleration imparted to the concrete filled into the block mold 6 should be of a constant order of magnitude. This condition is not fulfilled by any one of the conventional so-called board-type machines.

It is an object of the instant invention to provide a vibrator for a concrete block molding machine of the kind specified which vibrator permits the vibration to be adapted quickly and easily, during operation, to the specific requirements of pre- and final compaction and also to production pallets of different degrees of hardness.

The invention provides a vibrator with an infinitely variable amplitude. To accomplish that, two unbalanced vibrating devices are used which are arranged in parallel, driven externally, and designed as directional oscillators. They are driven at variable phase shifting by way of a regulator and distributor transmission. One embodiment also permits a vibrating frequency which is selectable infinitely.

If both pairs of vibrating shafts are disposed on top of each other, with the shafts being located at the four corners of a square, the space required for both directional oscillators is particularly small.

An arrangement of the vibrating shafts behind one another or in a horizontal plane leads to a particularly flat structure. In the latter case, the one pair of vibrating shafts is flanked at either side by one of the vibrating shafts of the other pair. This arrangement requires the two inner vibrating shafts and the two outer vibrating shafts to be mounted in forced synchronization. Another embodiment is conceivable with which the pairs of vibrating shafts are arranged behind each other.

A vibrating frequency which is variable during operation is obtainable either by means of an electric motor fed from a frequency converter or, less expensively, by an hydraulic drive unit. In this event an hydraulic engine is attached directly to the regulator and distributor transmission and is fed with pressurized oil from a pump of variable delivery volume (adjustment pump) which in turn is fed from a conventional motor, especially a three-phase or rotary current motor. Corresponding setting of the adjustment pump allows convenient influencing of the rotational speed of the hydraulic engine.

Amplitude adjustment which is variable during operation is accomplished by phase shifting of the at least two directional oscillators. It is convenient to use a conventional regulator and distributor transmission for this purpose (European patent No. 70 344, Bäumers et al.). Phase shifting of the two directional oscillators up to 180° not only causes a change in amplitude in correspondence with the vibrating intensity required. The phase shifting by 180° causes a complete cessation of vibrating table oscellations during the vibration-free periods of the operating cycle of the board-type machine in spite of the fact that the vibrating shafts revolve permanently.

A regulator and distributor transmission proved to be very resistant to wear if the direct meshing of gears was avoided by connecting the gears by a toothed belt which, at the same time, effects relative angular adjustment of the driven shafts and their drive gears. Such a regulator and distributor transmission will be explained in greater detail with reference to FIGS. 3 and 4. In this manner any tooth flank pressure variation which has a negative effect in the compensated state (phase shifting of 180°) of the vibrator by flyweight masses overtaking each other in the downward movement is safely avoided.

Changeover of the vibrator setting from the more gentle previbration to the more intensive principal vibration can be effected manually. It is convenient to provide means aiding in this adjustment in the vibrating zone in the form of an acceleration transmitter to which an indicator instrument is connected to give the operator an indication of the hardness of the production pallet used.

The use of a control means is especially advantageous. Both the amplitude and the frequency of pre-vibration and main vibration can be set automatically to different predetermined desired values by use of such a control means. When work is done with production pallets of different hardness, the control means likewise automatically sets the amplitude level which is effective towards the outside and the vibrating frequency such that optimum acceleration is achieved for compacting any given product (concrete mixture) by pre-vibration and principal vibration alike.

As a rule, compaction is achieved first by pre-vibration and then by principal vibration. Pre-vibration at the optimum values previously determined by testing is carried out upon clamping of a new production pallet between the block mold and the impact bars and filling of the block mold which has been positioned. In general, it is convenient to carry out the pre-vibration such that the amplitude is reduced to from 50 to 70%, especially about 60% of the amplitude of the main vibration. This will reduce the acceleration by the same percentage. To keep it constant, however, if required, the vibrating frequency is raised accordingly for compensation, i.e. it is increased such that the acceleration corresponds to the acceleration of the principal vibration.

The values mentioned for reducing the amplitude during pre-vibration differ as to the material and product in question. They are determined in the course of pretesting and adapted to the actual need during production of the concrete blocks.

During the pre-vibration an acceleration transmitter mounted on the vibrating table in the vibrating zone measures the property of the production pallet (hard or soft). In the intermission between pre-vibration and main vibration the values of amplitude level and vibrating frequency required for the subsequent principal vibration can be determined and set. In the course of the main vibration fine tuning may be accomplished within the shortest possible time by the control means, if provided.

An embodiment of a vibrator according to the invention will be described further, with reference to FIG. 2, and two associated regulator and distributor transmissions will be described further, with reference to FIGS. 3 and 4.

The vibrator consists of four structural assemblies, namely the vibrating table 3, a regulator and distributor transmission 26, an hydraulic unit 42, and a control means 50. Within the vibrating table 3 and below its upper surface thereof four vibrating shafts 15,16,17, and 18 are supported in pairs beside add on top of each other. One vibrating shaft each of the upper pair (upper directional oscillator) of vibrating shafts 15 and 16 and of the lower pair (lower directional oscillator) of vibrating shafts 17 and 18 is driven by a universal joint shaft 19 from the regulator and distributor transmission 26. All the vibrating shafts are unbalanced by the same amount of weight. The respective two horizontally adjacent vibrating shafts 15 and 16 as well as 17 and 18 are coupled by respective front end gears (not shown) such that the vibrating table is set into swinging motion in vertical direction only.

The two universal joint shafts 19 are driven by a regulator and distributor transmission 26 as known, for instance, from European Pat. No. 70 344. The hydraulic unit 42 serves as drive means. It comprises an hydraulic engine 27 flanged to the transmission 26. The transmission 26, on the one hand, functions to distribute the drive moment of the hydraulic engine 27 evenly to both universal joint shafts 19 and, on the other hand, to vary the phase position of the two universal joint shafts and thus of the superposed pairs of vibrating shafts according to the position of an adjustment cylinder 38. This has the consequence that, at one extreme setting, the vertical excitation of the lower vibrating shaft pair adds up to that of the upper vibrating shaft pair. In other words, the vibrating table oscillates at maximum amplitude level. At the other extreme setting the excitation of the lower shaft pair (directional oscillator) compensates that of the upper shaft pair (directional oscillator) so that the vibrating table is not set into swinging movement.

Supported in its casing 28, the regulator and distributor transmission 26 includes a first driven shaft 29 with a first gear 30, which shaft is adapted to be driven from drive motor 27. A second driven shaft 31 with a second gear 32 is supported parallel to the first one in the casing 28. Rocking arms 33 and 34, respectively, are supported for pivoting about the axes of the first and second driven shafts 29 and 31, Respectively. At their rear ends the rocking arms are interconnected by a guide link 35 at the same spacings from the axes of the driven shaft. The effective length of the guide link 35 is equal to the distance between axes of the two driven shafts. The first or lower rocking arm 33 further carries a first intermediate gear 36 meshing with the first gear 30, and the second or upper rocking arm 34 carries a second intermediate gear 37 of the same size meshing with the second gear 32, both intermediate gears being supported at the ends of the rocking arms opposite the guide link 35. Both rocking arms 33 and 34 are pivotable in common by an adjustment mechanism which acts by a rack 39 that is displaceable rectilinearly by the adjustment cylinder 38 on a toothed segment that is curved about the axis of the second driven shaft 31. Pivoting motion of the second rocking arm 34 about the axis of the second driven shaft 31 causes both intermediate gears 37 and 36 to rotate and the first intermediate gear 36 to turn the first gear 30 and, together with the same, the first driven shaft 29. In this manner the vibrating shaft 18 of the lower pair of vibrating shafts 17,18 (lower directional oscillator) which is fixed for rotation with the first driven shaft 29 by the lower universal joint shaft 19 is twisted with respect to the vibrating shaft 16 of the upper pair of vibrating shafts 15,16 (upper directional oscillator) so that the phase shift is varied. The phase relationship between the two directional oscillators is very finely variable during operation.

The respective excitation required of the vibrating table 3 depends not only on such characteristics of the board as the hardness, flatness, aging, etc. but also on the contact pressure of the concrete block mold 6.

These variables influence the vibrational behavior of the vibrating table 3, whereby an acceleration transmitter 21 at the vibrating table measures a value of the excitation.

The measurement values furnished by the acceleration transmitter 21 are amplified by an electronic control means 50 and compared with desired values of pre-vibration and main vibration determined by testing and suitable for manual or other input. The control means 50 adjusts the adjustment cylinder 38 of the regulator and distributor transmission 26 by way of an hydraulic valve 51 in response to the deviation of the actual value from the desired value. The regulator and distributor transmission sets the phase position accordingly of the upper and lower pairs of vibrating shafts or directional oscillators, thus adjusting the amplitude of the vibrating table 3.

The speed of revolution of the hydraulic motor 27 of the regulator and distributor transmission 26 and thus the rotational speed of the vibrating shafts 15,16,17, and 18 is determined by the oil supply from an axial piston adjustment pump 44 of the hydraulic unit 42 which pump is adjustable by an adjustment cylinder 43 and driven by a three-phase current motor 45. The desired number of revolutions depends on the hardness of the production pallet 5 and likewise is controlled by the control means 50 in response to the measurement value furnished by the acceleration transmitter 21.

The per se known regulator and distributor transmission 26 serves for infinitely variable adjustment of the phase position and thus of the amplitude level from its maximum value to the absolute cancellation thereof, i.e. to the elimination of any vibration while the unbalanced shafts revolve and it serves for distributing the power supplied by the hydraulic motor 27 attached to the transmission 26 to the two dual-shaft vibrators (directional oscillators) composed of the pairs of vibrating shafts 15,16 and 17,18 and integrated in the vibrating table 3.

In addition to the three-phase current motor 45 with the axial piston adjustment pump 44 which is flange-connected to it, the hydraulic unit 42 includes all the further known components which are required for safe operation.

Figure 2:
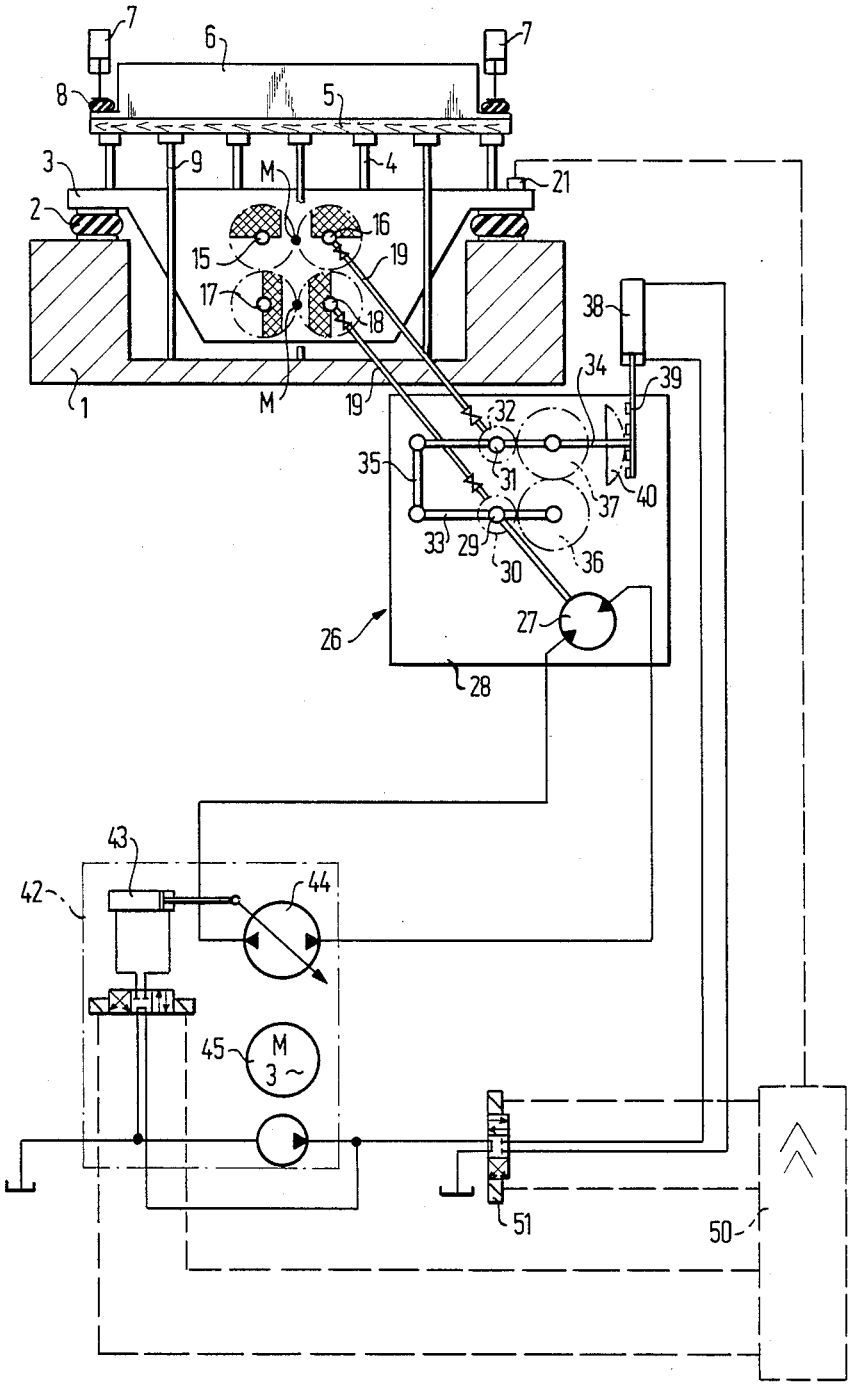
Figure 3:
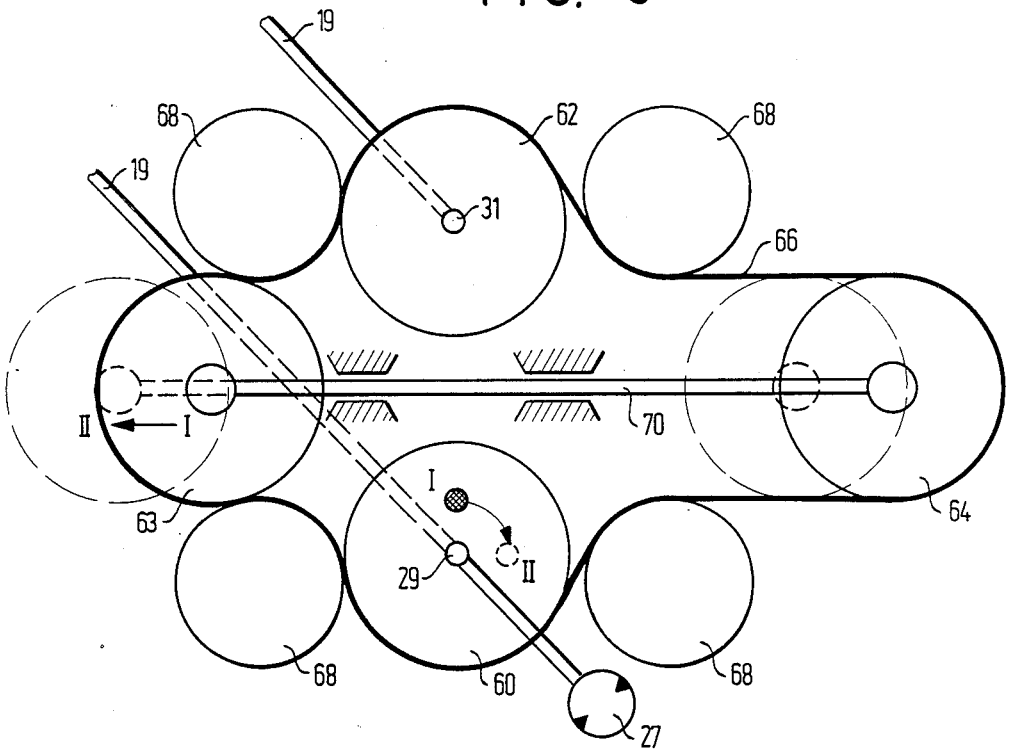

FIG. 3 shows a regulator and distributor transmission embodied as a toothed belt gear transmission which is used with preference instead of the mechanical adjustment drive according to FIG. 2. Only the most important elements for proper functioning are shown diagrammatically in the drawing, while the adjusting means is not illustrated. It may be of the same design as with the embodiment shown in FIG. 2.

Driven shaft 29 of the two driven shafts 29 and 31 again may be driven by an hydraulic motor 27 and, instead of gear 30 of the embodiment according to FIG. 2, it comprises a first toothed belt pulley 60. The second driven shaft 31 comprises a scion toothed belt pulley 62 instead of gear 32 in the case of the embodiment according to FIG. 2. Once more, a universal joint shaft 19 each is connected to the driven shafts 29 and 31 to drive the four vibrating shafts 15,16,17, add 18. A deflecting toothed belt pulley each 63 and 64 is located at either side, at the left and right in the drawing, of the toothed belt pulleys 60 and 62 which are arranged one above the other. Both deflecting pulleys 63 and 64 are supported on a slide 70. The supporting conveniently may be such that the spacing between the two pulleys is variable. To achieve that, it is sufficient for one of the two pulleys to be supported for displacement so as to be movable away from the other pulley for tensioning of the toothed belt. An endless toothed belt 66 is wrapped tightly around the four toothed belt pulleys 60, 62, 63 and 64 so that all the pulleys rotate in the same rotational sense. The direction of rotation is determined by the driving direction of rotation of toothed belt pulley 60.

Guide rollers 68 acting on the backside of the toothed belt 66 are located at either side of the toothed belt pulleys 60 and 62. The guide rollers are arranged in such manner that the respective runs of the toothed belt pulley extending between the guide rollers 68 and the deflecting pulleys 63 and 64 are parallel to each other. The guide rollers 68 at the same time increase the angle of wrap around the toothed belt pulleys 60 and 62.

The mode of operation of the regulator and distributor transmission is as follows: Lateral shifting of slide 70 from position I into position II, shown in discontinuous lines, with the aid of an hydraulic cylinder corresponding to adjustment cylinder 38 of FIG. 2, causes no change of the toothed belt length required. Yet this displacement of the two toothed belt pulleys 63 and 64 in the same direction does cause a change in the angular position of toothed belt pulley 60 with respect to toothed belt pulley 62. A point on toothed belt pulley 60 travels from position I by 90°, for example, to position II, whereas the corresponding point on toothed belt pulley 62 remains unchanged. The displacement may be as much as 180° so that the lower pair of shafts of the vibrating unit connected to the toothed belt pulley 60 by a first universal joint shaft 19 may be twisted with respect to the upper shaft pair by 180°. In this manner maximum excitation or total compensation thereof is obtained in the said manner as with the regulator and distributor transmission 26 in accordance with FIG. 2.

Figure 4:
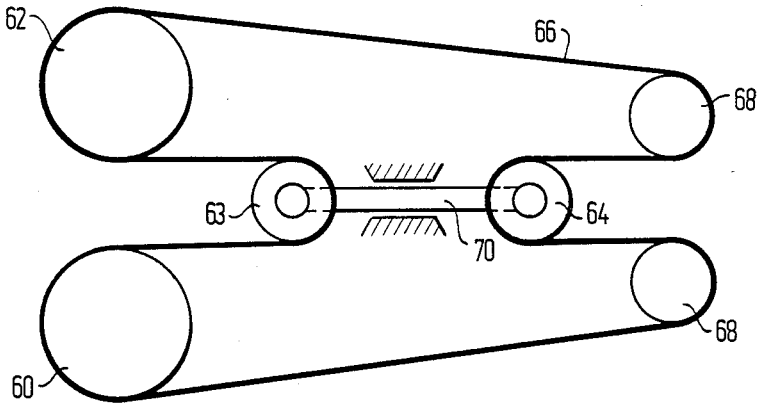

FIG. 4 is a diagrammatic presentation of another embodiment which makes use of only two guide rollers 68, e.g. the two guide rollers disposed to the right of driven shafts 29 and 31 with their toothed belt pulleys 60 and 62. The toothed side of the toothed belt 66 is wrapped around the guide rollers as well as the toothed belt pulleys 60 and 62. In horizontal direction, the guide rollers are located at such distance from the driven shafts that both deflecting pulleys 63 and 64 are disposed between the toothed belt pulleys 60, 62 and the guide rollers 68. The toothless side of the toothed belt 66 is wrapped around the sides facing each other of the deflecting pulleys 63 and 64 whereby the belt is tightened when these two pulleys are moved toward each other or the guide rollers 68 are moved away from the pair of toothed belt pulleys 60 and 62.

What is claimed is:

1. A vibrator for a concrete block molding machine to make molded concrete blocks, comprising a resiliently supported vibrating table suitable for receiving board-like production pallets with a block mold thereon, said production pallets horizontally positioned on a plurality of support bars of said table, intermediate spring members positioned for forcing said pallets against impact bars which are fixed on the machine, and an unbalanced vibrating drive means designed as a directional oscillator which is adapted to be driven at different amplitudes and comprises horizontal, parallel, positively synchronized, counter-rotating vibrating shafts suitable for generating an outwardly effective vibrating force in only the vertical direction through the support bars so that the support bars knock against the bottom side of the production pallet, wherein the vibrating drive means comprises two pairs of unbalanced vibrating shafts supported side by side and parallel to a respective center line therebetween, said vibrating shafts being adapted to be driven at the same rotational speed in forced synchronization and contrary sense and being supported such that the center lines of the two pairs extend in parallel in a vertical central plane therebetween, a regulator and distributor transmission for the drive of the vibrating shafts, said transmission being connected by universal joint shafts to a vibrating shaft of each pair and permitting independent, infinitely variable adjustment of the phase relationship of the vibrating oscillations of the two vibrating shaft pairs with respect to each other, and a means by which the regulator and distributor transmission is adjustable from a first phase relationship for pre-vibration to a second phase relationship for main vibration.

2. The vibrator as claimed in claim 1, wherein the two pairs of vibrating shafts are arranged on top of each other.

3. The vibrator as claimed in claim 1, wherein all vibrating shafts are supported in a horizontal plane, and wherein at either side of the one pair of vibrating shafts there is arranged one vibrating shaft each of the other pair of vibrating shafts.

4. The vibrator as claimed in claim 1, wherein a drive unit of adjustable rotational speed is provided for the drive of the regulator and distributor transmission, and wherein a means is provided by which the drive unit is adjustable from a first driving speed for pre-vibration to a second driving speed for main vibration.

5. The vibrator as claimed in claim 4, wherein the drive unit is an electric motor of adjustable rotational speed and fed from a frequency converter.

6. The vibrator as claimed in claim 4, wherein the drive unit comprises an hydraulic motor and a pump of adjustable delivery volume feeding the same and being driven by a motor to adjust the rotational speed of the hydraulic.

7. The vibrator as claimed in claim 1, wherein the means for adjusting the regulator and distributor transmission and/or the drive unit is a control means which senses the acceleration of the vibrating table or the production pallet by means of an acceleration transmitter mounted in the vibrating zone, and compares the same with at least one desired value of pre-vibration and one desired value of main vibration, and adjusts the amplitude level and the vibrating frequency by way of the phase position.

8. The vibrator as claimed in claim 7, wherein the control means adjusts the amplitude level during pre-vibration to from 50–70%, approximately 60% of the amplitude level of the main vibration.

9. The vibrator as claimed in claim 8, wherein the control means includes means for increasing the vibrating frequency during pre-vibration to such a degree that the acceleration corresponds approximately to the acceleration of the main vibration.

10. The vibrator as claimed in claim 8 or 9, wherein the control means includes means for determining the desired value of amplitude level and vibrating frequency of the main vibration from the acceleration measured by the acceleration transmitter during pre-vibration at a certain amplitude level and vibrating frequency.

11. The vibrator as claimed in claim 1, wherein the regulator and distributor transmission comprises a first driven shaft with a first toothed bell pulley and a second driven shaft with a second toothed belt pulley, wherein furthermore a deflecting pulley each is supported at either side of the belt pulley pair, the deflecting pulleys together being adjustable transversely the belt pulley pair, and wherein an endless toothed belt is wrapped tightly around these four pulleys.

12. The vibrator as claimed in claim 1, wherein the regulator and distributor transmission comprises a first driven shaft with a first toothed bell pulley and a second driven shaft with a second toothed belt pulley, wherein furthermore a guide roller each is supported at one side of each toothed belt pulley and two deflecting pulleys are supported between the belt pulley pair and the guide roller pair, the deflecting pulleys together being adjustable transversely of the belt pulley pair, and wherein an endless belt is wrapped tightly around these six pulleys and guide rollers, respectively.

13. The vibrator as claimed in claim 11 or 12, wherein the two deflecting toothed belt pulleys are supported jointly on a slide.

14. The vibrator as claimed in one of claims 11 or 12, wherein the spacing between the deflecting toothed belt pulleys is variable.

15. The vibrator as claimed in one of claims 11 or 12, wherein guide rollers acting on the backside of the toothed belt are provided laterally of the toothed belt pulleys to increase the angle of wrap around the toothed belt pulleys.

16. The vibrator as claimed in claim 12, wherein the respective runs of the toothed belt between the guide rollers and the deflecting toothed belt pulleys extend in parallel with each other.

* * * * *

UNITED STATES PATENT AND TRADEMARK OFFICE

CERTIFICATE OF CORRECTION

PATENT NO. : 4,830,597 Page 1 of 2

DATED : May 16, 1989

INVENTOR(S) : Klaus F. Steier, Erich W. Holthaus and Hermann Kargl

It is certified that error appears in the above-identified patent and that said Letters Patent is hereby corrected as shown below: On the title page:

Under Foreign Application Priority Date:

"Aug. 27, 1986 [DE] Fed. Rep. of Germany 3629078" should read --Aug. 27, 1986 [DE] Fed. Rep. of Germany 3629078.5--.

Under References Cited U.S. Patent Documents:

"1,118,103 11/1914 Beierlein" should read --1,118,103 11/1961 Beierlein--.

"1,154,408 9/1915 Steuermann" should read --1,154,408 9/1963 Steuermann--.

"2,703,405 3/1955 Pappers" should read --2,703,405 8/1978 Pappers--.

and

"2,736,264 3/1956 Fechter" should read --2,736,264 3/1979 Fechter--.

UNITED STATES PATENT AND TRADEMARK OFFICE

CERTIFICATE OF CORRECTION

PATENT NO. : 4,830,597

DATED : May 16, 1989

INVENTOR(S) : Klaus F. Steier, Erich W. Holthaus and Hermann Kargl

It is certified that error appears in the above-identified patent and that said Letters Patent is hereby corrected as shown below:

Column 1 Line 57 "threephase" should read --three-phase--.

Column 2 Line 23 "th" should read --the-- (third occurrence).

Column 4 Line 48 "add" should read --and--.

Column 7 Line 32 "toward" should read --towards--.

Claim 12 Column 8 Line 60 "bell" should read --belt--.

Signed and Sealed this

Tenth Day of April, 1990

*Attest:*

HARRY F. MANBECK, JR.

*Attesting Officer*

*Commissioner of Patents and Trademarks*